US005532093A

United States Patent [19]

Yuh et al.

[11] Patent Number: 5,532,093

[45] Date of Patent: Jul. 2, 1996

[54] IMAGING MEMBER

[75] Inventors: Huoy-Jen Yuh, Pittsford; William G. Herbert, Williamson; Gary J. Maier, Webster, all of N.Y.

[73] Assignee: Xerox Corporation, Stamford, Conn.

[21] Appl. No.: 395,133

[22] Filed: Feb. 27, 1995

[51] Int. Cl.[6] ..... G03G 5/14

[52] U.S. Cl. ..... 430/58; 430/65

[58] Field of Search ..... 430/64, 65, 58

[56] References Cited

U.S. PATENT DOCUMENTS

| | | | |
|---|---|---|---|
| 3,907,650 | 9/1975 | Pinsler | 204/34 |
| 3,914,126 | 10/1975 | Pinsler | 96/1.5 |
| 4,098,655 | 7/1978 | Ward et al. | 204/38 A |
| 4,557,993 | 12/1985 | Matjakowkski | 430/131 |
| 5,215,853 | 6/1993 | Andrews et al. | 430/131 |
| 5,372,904 | 12/1994 | Yu et al. | 430/64 |
| 4,0134,463 | 3/1977 | Leder | 96/1.5 |

*Primary Examiner*—John Goodrow
*Attorney, Agent, or Firm*—Zosan S. Soong

[57] ABSTRACT

There is disclosed an electrostatographic imaging member comprising: (a) a supporting substrate including an electrically conductive surface; (b) a nickel containing layer comprised of nickel, oxygen, and sulfur, wherein the nickel containing layer is the sole charge blocking layer; and (c) at least one electrostatographic imaging layer.

10 Claims, No Drawings

IMAGING MEMBER

This invention relates generally to an imaging member, and more specifically to a photoreceptor including a nickel containing layer comprised of nickel, oxygen, and sulfur, wherein the nickel containing layer is the sole charge blocking layer. The imaging member is incorporated in an electrostatographic printer or copier. The nickel containing layer described herein can be colloquially referred to as a black nickel layer (although the color of the layer may depend upon its thickness).

Andrews et al., U.S. Pat. No. 5,215,853 ("Andrews patent"), the disclosure of which is totally incorporated by reference, discloses a layered photosensitive imaging member that is modified to minimize optical interference occurring within the imaging member from monochromatic laser light which may result in a type of defect in output prints called a plywood effect. Where this defect occurs, the output copy exhibits a pattern of light and dark interference fringes which look like the grains on a sheet of plywood, hence the phrase plywood effect. The modification described is to form the ground plane surface by an electroforming process which leaves the surface with a black finish such as a black nickel layer. In column 3, lines 25–27, the Andrews patent discloses the presence of an additional layer, the charge blocking layer.

The present inventors have discovered that it is possible in embodiments to fabricate an electrostatographic imaging member having a black nickel layer as the sole charge blocking layer, thereby eliminating the use of an additional, separate layer as the charge blocking layer.

Other documents which may be of interest are the following which disclose the use of a nickel oxide layer in an imaging member: Pinsler, U.S. Pat. No. 3,914,126, Pinsler, U.S. Pat. No. 3,907,650, Matyjakowski, U.S. Pat. No. 4,557,993, Leder, U.S. Pat. No. 4,013,463, and Ward et al., U.S. Pat. No. 4,098,655.

SUMMARY OF THE INVENTION

The present invention is accomplished in embodiments by providing an electrostatographic imaging member comprising:

(a) a supporting substrate including an electrically conductive surface;

(b) a nickel containing layer comprised of nickel, oxygen, and sulfur, wherein the nickel containing layer is the sole charge blocking layer; and (c) at least one electrostatographic imaging layer.

In embodiments, there is further provided an electrostatographic imaging member comprising:

(a) a supporting substrate including an electrically conductive surface;

(b) a nickel containing layer comprised of nickel, oxygen, and sulfur, contiguous to the electrically conductive surface, wherein the nickel containing layer is the sole charge blocking layer;

(c) a charge generating layer; and (d) a charge transport layer.

DETAILED DESCRIPTION

The electrostatographic imaging member of the present invention comprises the following: a supporting substrate including an electrically conductive surface; a nickel containing layer comprised of nickel, oxygen, and sulfur, wherein the nickel containing layer is the sole charge blocking layer; at least one electrostatographic imaging layer; and optionally one or more additional layers typically employed in a photoreceptor including for example an adhesive layer, an anticurl layer, and an overcoat layer. In embodiments, either the charge generating layer or the charge transport layer is contiguous to the nickel containing layer. An optional adhesive layer between the nickel containing layer and the charge generating layer or between the nickel containing layer and the charge transport layer may be desired to promote adhesion.

A description of suitable materials for the imaging member of the present invention follows.

THE SUBSTRATE INCLUDING AN ELECTRICALLY CONDUCTIVE SURFACE

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 10 centimeters, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating nonconducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like.

Preferably, the substrate is fabricated by an electrodeposition process including electroplating or electroforming. Electrodeposition processes, such as electroforming processes, are illustrated in Bailey et al., U.S. Pat. No. 3,844,906, and Herbert, U.S. Pat. No. 4,501,646, the disclosures of which are totally incorporated by reference.

Higher quality output prints, such as those free from the plywood effect and/or pinholes, may be produced in embodiments by using the instant imaging member having a relatively smooth substrate surface as compared with output prints produced by the instant imaging member having a relatively rougher substrate surface. Thus, in preferred embodiments, the substrate has a relatively smooth surface having a $R_a$ value (mean roughness) ranging for example from about 0.02 to about 2.1 microns, preferably from about 0.13 to about 1.3 microns, and especially from about 0.4 to about 0.9 micron. $R_a$ is the arithmetic average of all departures of the roughness profile from the mean line within the evaluation length. The surface roughness parameter $R_a$ may be determined for example by a Perthen Surface Profilometer Model #S8P, available from Mahr Feinpruef Corp., by utilizing a 5 micron radius contact probe which rides over the surface and directly, by contact, measures the surface contour. An alternate attachment for the Perthen Surface Profilometer Model #S8P can measure the surface by projecting a laser beam onto the surface and measuring the change in focal length observed as the beam scans across the surface. It is understood that other devices and methods equivalent to those disclosed herein may also be employed to measure the surface roughness.

THE NICKEL CONTAINING LAYER

The nickel containing layer comprises a mixture of atoms and molecules of nickel, oxygen, and sulfur. Other substances such as zinc, carbon, sodium, and/or molybdenum also may be present, depending on the bath composition (and the impurities which may be present) used to form the nickel containing layer. Nickel may be present in several forms including for example a sulfide, a sulfate, and a hydroxide. Zinc may also be present in several forms including for example a sulfide, a sulfate, and a hydroxide. Carbon may be present in several bonding types including C—C, C—O, —COO, and C=O. The components of the black nickel layer may be present in the following illustrative amounts (percentages are by weight based on the weight of the black nickel layer): nickel, from about 8% to about 20%, and preferably from about 10% to about 15%; oxygen, from about 30% to about 55%, and preferably from about 40% to about 50%; and sulfur, from about 2% to about 15%, and preferably from about 5% to about 10%. One or more of the following components may also be present in the black nickel layer in the illustrative amounts (percentages are by weight based on the weight of the black nickel layer): carbon, from about 15% to about 40%, and preferably from about 20% to about 30%; zinc, from about 5% to about 20%, and preferably from about 10% to about 15%; molybdenum, from about 5% to about 20%, and preferably from about 10% to about 15%; and sodium, less than 1%, and preferably from about 0.01% to about 0.8%. In one embodiment, as determined by X-Ray Photoelectron Spectroscopy, the nickel containing layer included the following components (percentages by weight): 27% carbon, 44% oxygen, 12% nickel, 11% zinc, 6% sulfur, and less than 1% sodium. In embodiments of the instant invention, the surface of the nickel containing layer may be a mixture of nickel sulfides, sulfates, and hydroxides and optionally zinc sulfides, sulfates, and hydroxides, where there may be no nickel oxide detectable at the surface. The nickel containing layer may have a thickness ranging for example from about 0.005 to about 25 microns, preferably from about 0.1 to about 2 microns, and especially from about 0.3 to about 1 micron. The nickel containing layer functions as a charge blocking layer, preferably a hole blocking layer which can transport electrons.

Methods for the electrodeposition of a black nickel layer are illustrated in Andrews et al., U.S. Pat. No. 5,215,853. The following procedure illustrates the formation of the substrate and the nickel containing layer where the substrate for the purposes of illustration is a flexible, seamless nickel belt. The belt is electrodeposited on a cylindrically shaped mandrel which is suspended in an electrolytic bath (nickel sulfamate solution). A DC potential is applied between the rotating mandrel cathode and the donor metallic nickel anode for a sufficient period of time to effect electrodeposition of nickel on the mandrel to a predetermined thickness (0.0010 to 0.010 inch are typical thicknesses). Following formation of the belt substrate, the electroform is modified to make it slightly anodic (0.050 V to 0.450 V versus Saturated Calomel Electrode) rather than the normal cathodic and the nickel containing layer is electrodeposited onto the belt. Thus, the nickel containing layer is advantageously formed in situ. Upon completion of the electroforming process, the mandrel and the nickel belt formed thereon are transferred to a cooling zone whereby the belt, which exhibits a different coefficient of thermal expansion than the mandrel, can be readily separated from the mandrel. The surface roughness of the belt may be controlled to provide the desired surface smoothness (or roughness). The imaging layer or layers may be deposited on the nickel containing layer using conventional techniques known in the art.

THE ADHESIVE LAYER

The optional adhesive layer preferably has a dry thickness between about 0.001 micrometer to about 0.2 micrometer. A typical adhesive layer includes film-forming polymers such as polyester, du Pont 49,000 resin (available from E. I. du Pont de Nemours & Co.). VITEL-PE 100™ (available from Goodyear Rubber & Tire Co.), polyvinylbutyral, polyvinylpyrrolidone, polyurethane, polymethyl methacrylate, and the like.

THE IMAGING LAYER(S)

The imaging layer or layers may comprise for example a photoconductive material and a charge transport material in the same layer or different layers. Illustrative photoreceptors, charge generating materials, charge transport materials, and photoreceptor fabrication techniques are disclosed in for example in U.S. Pat. Nos. 4,265,990; 4,390,611; 4,551,404; 4,588,667; 4,596,754; 4,797,337; 4,965,155; and 5,004,662, the disclosures of which are totally incorporated by reference.

The photoconductive material is capable in embodiments of generating electronic charge carriers in response to the absorption of radiation to be recorded by the imaging photoreceptor. The photoconductive material may be any suitable organic or inorganic photoconductor. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Charge transport materials include an organic polymer or nonpolymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly(vinylperylene). Suitable electron transport materials include electron acceptors such as 2,4,7-trinitro-9-fluorenone; 2,4,5,7-tetranitrofluorenone; dinitroanthracene; dinitroacridene; tetracyanopyrene and dinitroanthraquinone.

The instant invention may provide a number of advantages in embodiments. For example, the black nickel layer may adhere more firmly to the substrate than other charge blocking materials such as polyvinylbutyral, polyesters, and polyamides like nylon 8. In addition, the materials employed in the charge generating layer may adhere more firmly to the black nickel layer than to other charge blocking materials such as polyvinylbutyral, polyesters, and polyamides like nylon 8. The presence of the black nickel layer may obviate the need for an adhesive layer. In embodiments, the black nickel layer may be employed to minimize the plywood effect in a manner similar to that disclosed in Andrews et al., U.S. Pat. No. 5,215,853.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

A photoreceptor was prepared as follows. The nickel containing layer was electrodeposited onto an electroformed nickel drum having an outside diameter of about 40 mm, a wall thickness of about 5 mil, and a surface roughness $R_a$ value of about 0.4 to about 0.9 micron, by employing the following bath composition:

nickel chloride: 75 g/L;

ammonium chloride: 30 g/L;

sodium thiocyanate: 15 g/L; and zinc chloride: 30 g/L.

The pH was adjusted to 5.0 and the electrodeposition was done at room temperature, i.e., about 25° C. A current density of about 0.6 amps per square foot was used for 20 minutes. The nickel drum was rinsed with water and air dried. The nickel containing layer functioned as the charge blocking layer and had a thickness of about 0.5 micron.

The imaging layers were prepared as follows. The charge generating layer was then dip coated onto the nickel containing layer and was dried at about 115° C. for about 10 minutes. The dried charge generating layer had a thickness of about 0.2 micron. The charge generating layer was prepared from a 3% by weight solids solution of titanyl phthalocyanine and polyvinylbutyral B79 (available from Monsanto Chemical Company) (68/32 weight %) in cyclohexanone. The charge transport layer was dip coated onto the charge generating layer and was dried at about 130° C. for about 60 minutes. The dried charge transport layer had a thickness of about 20 microns. The charge transport layer was prepared from a 3% by weight solids solution of N,N'-diphenyl-N,N'-bis(3-methylphenyl)-( 1,1'-biphenyl)-4,4'diamine and poly(4,4'-diphenyl-1,1'-cyclohexane carbonate) (35/65 weight %) in monochlorobenzene.

The photoreceptor was tested in a cyclic scanner at ambient conditions, i.e., about 25° C., for charge erase cycling. The device was first charged with a scorotron, then measured the surface voltage ($V_o$) 0.16 second after charging. The surface voltage ($V_{ddp}$) was measured again 0.47 second after charging. The voltage difference between $V_o$ and $V_{ddp}$ was the dark decay. The measured $V_{ddp}$ and dark decay values are indicated in the table below.

COMPARATIVE EXAMPLE 1

A comparative photoreceptor was prepared and tested in the same manner as in Example 1 except the nickel containing layer was absent. The measured $V_{ddp}$ and dark decay values are indicated in the table below.

COMPARATIVE EXAMPLE 2

A comparative photoreceptor was prepared and tested in the same manner as in Example 1 except that an aluminum substrate was used in place of the nickel substrate and a nylon containing charge blocking layer replaced the nickel containing layer. The roughness ($R_a$) of the honed aluminum surface was from about 0.4 to about 0.9 micron. Honing was performed by causing a slurry of glass beads and water to contact the surface of the aluminum with sufficient force to obtain the desired surface roughness. The nylon charge blocking layer was fabricated from a 8 weight percent solution of nylon 8 in butanol, methanol, and water mixture. The butanol, methanol, and water mix ratio was 55, 36, and 9 weight percent respectively. This nylon containing blocking layer was dip coated onto the aluminum substrate and was dried at a temperature of about 105° C. for about 5 minutes. The dried nylon containing blocking layer had a thickness of about 1.5 micron. The measured $V_{ddp}$ and dark decay values are indicated in the table below.

TABLE

| EXAMPLE NUMBER | $V_{ddp}$ | Dark Decay |
|---|---|---|
| Example 1 (invention) | 390 V | 12 V |
| Comparative Example 1 (no black nickel layer) | 361 V | 43 V |
| Comparative Example 2 (Al substrate with nylon layer as blocking layer) | 399 V | 7 V |

As seen in the table above, Example 1 (invention) exhibited superior charge blocking as compared with Comparative Example 1.

Other modifications of the present invention may occur to those skilled in the art based upon a reading of the present disclosure and these modifications are intended to be included within the scope of the present invention.

We claim:

1. An electrostatographic imaging member comprising:

(a) a supporting substrate including an electrically conductive surface;

(b) a nickel containing layer comprised of nickel, oxygen, and sulfur, wherein the nickel containing layer is the sole charge blocking layer; and (c) at least one electrostatographic imaging layer.

2. An electrostatographic imaging member comprising:

(a) a supporting substrate including an electrically conductive surface;

(b) a nickel containing layer comprised of nickel, oxygen, and sulfur, contiguous to the electrically conductive surface, wherein the nickel containing layer is the sole charge blocking layer;

(c) a charge generating layer; and (d) a charge transport layer.

3. The member of claim 2, wherein the substrate is nickel.

4. The member of claim 2, wherein the substrate is electroformed nickel.

5. The member of claim 2, wherein the charge generating layer is contiguous to the nickel containing layer.

6. The member of claim 2, wherein the charge transport layer is contiguous to the nickel containing layer.

7. The member of claim 2, wherein an adhesive layer is disposed between the nickel containing layer and the charge generating layer.

8. The member of claim 2, wherein the nickel containing layer has a thickness ranging from about 0.005 to about 25 microns.

9. The member of claim 2, wherein the nickel containing layer further comprises zinc.

10. The member of claim 2, wherein the nickel containing layer comprises sulfur in an amount ranging from about 2% to about 15% by weight based on the weight of the nickel containing layer.

* * * * *